United States Patent [19]

Bauer

[11] 3,940,559

[45] Feb. 24, 1976

[54] COMPATIBLE FOUR CHANNEL RECORDING AND REPRODUCING SYSTEM

[75] Inventor: Benjamin B. Bauer, Stamford, Conn.

[73] Assignee: CBS Inc., New York, N.Y.

[22] Filed: Apr. 18, 1974

[21] Appl. No.: 462,042

[52] U.S. Cl. ..... 179/1 GQ; 179/15 BT
[51] Int. Cl.[2] ..... H04R 5/00
[58] Field of Search ..... 179/1 GQ, 100.4 ST, 15 BT

[56] References Cited

UNITED STATES PATENTS

| | | | |
|---|---|---|---|
| 3,761,628 | 9/1973 | Bauer | 179/1 GQ |
| 3,787,629 | 1/1974 | Limberg | 179/15 BT |
| 3,814,858 | 6/1974 | Parker | 179/15 BT |
| 3,824,342 | 7/1974 | Christensen et al. | 179/15 BT |

OTHER PUBLICATIONS

QFMX-Quadruplex FM Transmission using the 4-4-4 QMX Matrix System by Cooper Journal AES Mar., 1974, pp. 82–87.

Compatible FM Broadcasting of Panoramic Sound by Gibson et al., Journal AES Dec. 1972 pp. 816–822.

*Primary Examiner*—Kathleen H. Claffy
*Assistant Examiner*—Tommy P. Chin
*Attorney, Agent, or Firm*—Spencer E. Olson

[57] ABSTRACT

A compatible four channel sound system for use in conjunction with a recording system for recording four individual audio signals designated $L_f$, $L_b$, $R_b$ and $R_f$ on a recording medium having first and second primary information channels and first and second subsidiary information channels, the first and second primary information channels carrying information that is consistent and compatible with existing monophonic and stereophonic standards. In accordance with the preferred embodiment of the invention, means are provided for forming a first composite signal designated $L_T$ which contains, to the extent they are present, $L_f$ in a dominant proportion and $L_b$ and $R_b$ in subdominant proportions, $L_b$ and $R_b$ being phase shifted with respect to each other. Means are also provided for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other. Further means are provided for forming a first auxiliary signal by combining all of the individual audio signals, $L_f$, $L_b$, $R_b$ and $R_f$, to the extent they are present, and for forming a second auxiliary signal by combining all of these individual audio signals, $L_f$, $L_b$, $R_b$ and $R_f$, to the extent they are present, the individual audio signals being combined in different relative phase relationships in the first and second auxiliary signals.

6 Claims, 8 Drawing Figures

COMPATIBLE FOUR CHANNEL RECORDING AND REPRODUCING SYSTEM

BACKGROUND OF THE INVENTION

This invention relates to audio systems and, in particular, to a sound system adapted to record four or more individual channels of audio information containing directional information on a two track record medium and to reproduce the recorded information as four discrete audio output signals having the directionality of the original input signals. The subject matter of this application is related to subject matter in the co-pending application Ser. No. 462,044 entitled "Compatible Four Channel Radio Broadcast and Receiving System" filed of even date herewith and assigned to the same assignee as the present application.

In commercial stereophonic systems, two independent signals respectively modulate the two tracks (left and right walls) of a single groove record in two perpendicular directions. Typically, the groove is cut with modulation in each wall of the groove representing one of the signals and with lateral modulation representing the sum of the signals and vertical modulation representing the difference between the signals.

In my U.S. Pat. No. 3,761,628 there is disclosed a sound system wherein four individual audio signals, designated $L_f$, $L_b$, $R_b$ and $R_f$ are encoded in accordance with the "SQ" quadraphonic technique to produce two composite signals designated $L_T$ and $R_T$ and are also encoded to produce two additional "conjugate" composite signals which may be designated $L_T$* and $R_T$*. The composite signals $L_T$ and $R_T$ can be recorded at baseband frequency on the respective walls of stereophonic disc records and the "conjugate" composite signals $L_T$* and $R_T$* can be used to modulate carrier signals which are also recorded on the walls of the record groove. The referenced patent demonstrates that $L_T$ and $R_T$ can be decoded in conventional fashion using an "SQ" decoder matrix to produce four signals designated $L_f'$, $L_b'$, $R_b'$ and $R_f'$, each of these signals containing, in predominant proportion, a corresponding one of the four individual audio signals, along with certain "unwanted" components in sub-dominant proportions. For reproducing equipment that is capable of obtaining only $L_T$ and $R_T$, these four signals $L_f'$, $L_b'$, $R_b'$ and $R_f'$ suffice as satisfactory although not fully "discrete" outputs for audio reproduction. The patent demonstrates that $L_T$* and $R_T$*, which can be obtained using more sophisticated reproducing equipment, can also be processed using a "SQ" type of decoder, to produce four signals which may be designated $L_f'$*, $L_b'$*, $R_b'$* and $R_f'$*, and these latter four signals can be added to $L_f'$, $L_b'$, $R_b'$, and $R_f'$, respectively to recover the original four individual audio signals in fully discrete form. Thus, by providing the record with appropriate "auxiliary signals" (i.e., $L_T$* and $R_T$*), consumers are given a choice as to the level of sophistication and expense of their reproducing equipment. Consumers having equipment with full capability can obtain four fully discrete audio outputs and those having less expensive matrix decoding equipment alone can obtain four conventional "SQ" outputs. Also, since the "SQ" composite signals on the disc basebands are fully compatible with stereophonic and monophonic reproduction, the needs of consumers having only the basic stereo or mono players are satisfied.

The sound system of the above-referenced patent is satisfactory, but it is an object of the present invention to provide a compatible four channel system which offers even greater flexibility options to the consumer and also offers certain performance advantages.

SUMMARY OF THE INVENTION

The present invention is directed to a compatible four channel sound system for use in conjunction with a recording system for recording four individual audio signals designated $L_f$, $L_b$, $R_b$ and $R_f$ on a recording medium having first and second primary information channels and first and second subsidiary information channels, the first and second primary information channels carrying information that is consistent and compatible with existing monophonic and stereophonic standards. In accordance with the preferred embodiment of the invention, means are provided for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other. Means are also provided for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other. Further means are provided for forming a first auxiliary signal by combining all of the individual audio signals, $L_f$, $L_b$, $R_b$ and $R_f$, to the extent they are present, and for forming a second auxiliary signal by combining all of these individual audio signals, $L_f$, $L_b$, $R_b$ and $R_f$, to the extent they are present, the individual audio signals being combined in different relative phase relationships in the first and second auxiliary signals. The first and second composite signals are applied to the first and second primary information channels and the first and second auxiliary signals are applied to the first and second subsidiary information channels, respectively. In accordance with the preferred embodiment of the invention, a decoder responsive to the signals carried by the recording medium is provided and includes matrix means for combining the first and second composite signals in predetermined amplitude and phase relationships to obtain four intermediate signals, each of which has a different one of the individual audio signals predominant. The decoder also includes means for combining the first auxiliary signal with each of the intermediate signals to obtain four enhanced intermediate signals each of which has a different one of the individual audio signals predominant. Finally, the decoder includes means for combining the second auxiliary signal with each of the enhanced intermediate signals to recover the four individual audio signals, $L_f$, $L_b$, $R_b$ and $R_f$, in substantially their original form.

In the preferred embodiment of the invention the composite signals $L_T$ and $R_T$ are encoded in accordance with the "forward looking" type of "SQ" code. This facilitates the use of auxiliary signals which can be provided at reduced relative amplitudes with respect to the components of the composite signals.

Further features and advantages of the invention wll become more readily apparent from the following detailed description when taken in conjunction with the accompanying drawings.

DESCRIPTION OF THE PREFERRED EMBODIMENT

Figure 1:
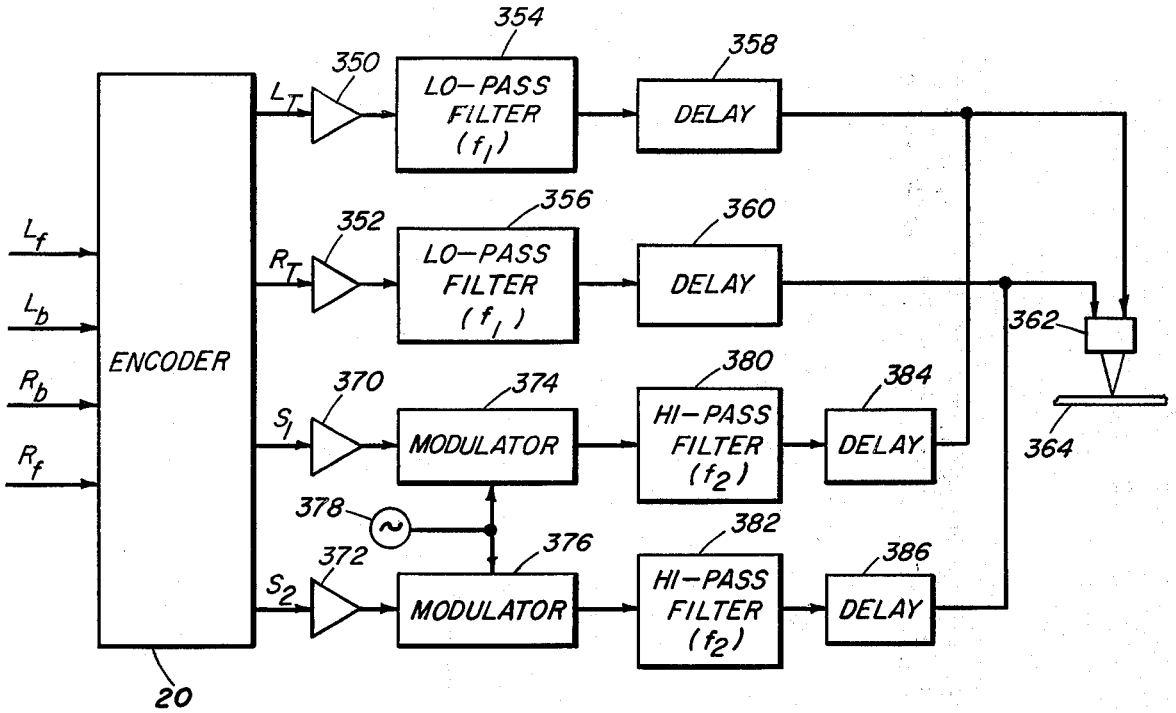
FIG. 1 is a simplified block diagram of a recording system of a type suitable for use in conjunction with the invention.

Referring to FIG. 1, there is shown an embodiment of a four channel recording system arranged according to the present invention. Four individual and independent audio signals, designated $L_f$, $L_b$, $R_b$ and $R_f$, are received by an encoding block 20 which includes, inter alia, an "SQ" encoder for producing "SQ" composite signals designated $L_T$ and $R_T$ and additional encoding circuitry for generating auxiliary signals designated $S_1$ and $S_2$. The composite signals $L_T$ and $R_T$ are amplified by respective amplifiers 350 and 352 and filtered with respective filter networks 354 and 356, each of which has a high frequency cutoff at a frequency $f_1$, which is at or near the highest audio frequency of interest, typically 15,000 Hz. The outputs of filters 354 and 356 are respectively passed through suitable delay networks 358 and 360, the purpose of which will be described later, and applied to the left and right input terminals, respectively, of a stereophonic cutter 362 in cooperative relationship with a disc 364. Thus, the two composite signals delivered by the encoder 20 are recorded on the two walls of the disc groove in a manner entirely similar to that used in making a conventional matrix stereophonic disc.

The auxiliary signals $S_1$ and $S_2$ produced by encoder 20 are recorded on the walls of the disc groove as modulation on respective carrier signals. These two composite signals are first amplified by respective amplifiers 370 and 372 and then applied to respective modulators 374 and 376, each of which may have a self-contained source of carrier signal or, as illustrated, they may be energized by external carrier frequency generator 378. A function of the modulators 374 and 376 is to translate the frequency of the auxiliary signals to a frequency range above the baseband spectrum. Typically, the carrier frequency is of the order of 20 KHz and is amplitude modulated from about 5 to 35 KHz. The modulated carriers delivered by the two modulators are passed through respective filters 380 and 382, each designed to reject the lower sideband (i.e., frequency below a lower cutoff frequency $f_2$) leaving essentially only the carrier and upper sideband. The signals passed by the filters are delayed by respective delay networks 384 and 386 and then combined with the output signals from delay networks 358 and 360, respectively, for application to the cutter 362. The delay networks 358, 360, 384 and 386 are provided to equalize the delays present in the four paths of the system due to the modulation process and filtering so that signals recorded on the disc bear a relative time-domain relationship such that upon replay they can be decoded and recombined with a minimum of time-delay error.

For purposes of the present application an information "channel" is defined as that portion of a recording medium utilized to carry an audio signal having a specified bandwidth of interest. No particular physical location on a recording medium need be identifiable with a particular channel. Thus, in the present embodiment, each wall of the record groove carries two "channels"; viz., a primary information channel which carries a composite signal ($L_T$ or $R_T$) at baseband frequency range and a subsidiary information channel which carries the auxiliary signal ($S_1$ or $S_2$) at the carrier sideband frequency range. However, it will be appreciated that the primary and subsidiary information channels can occupy any desired physical location or frequency range on a recording medium, such as four independent tracks on a magnetic tape medium.

Figure 2:
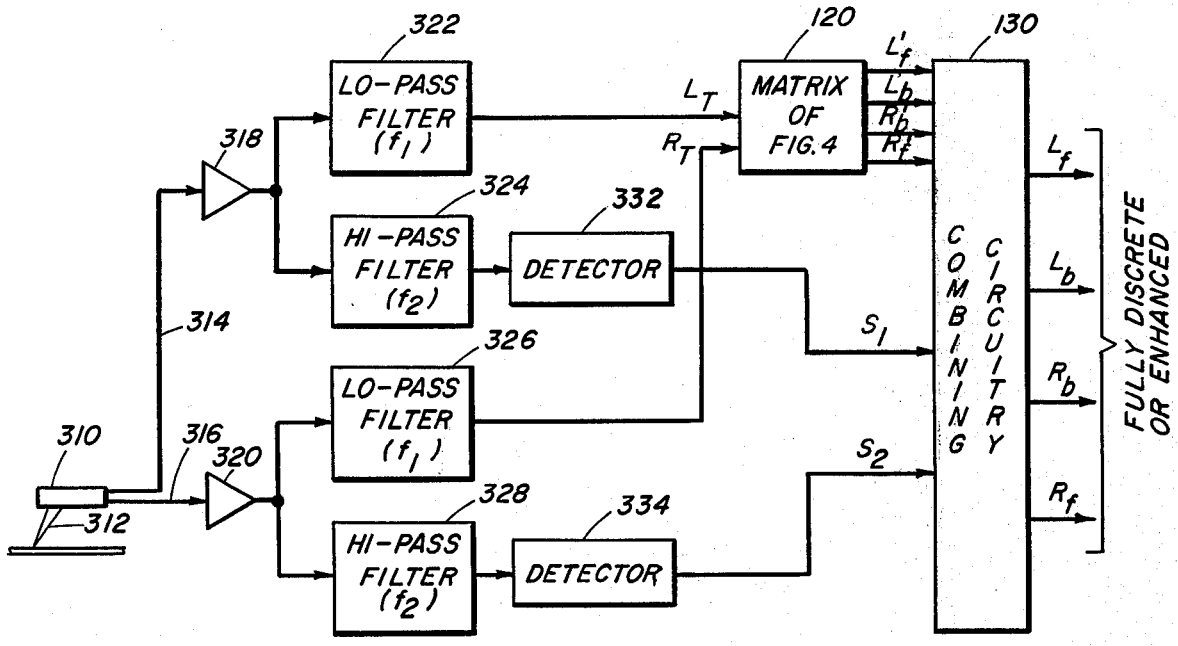
FIG. 2 is a block diagram of a reproducing system in accordance with the invention.

FIG. 2 shows an embodiment of a four channel record reproducing system which includes a stereophonic disc phonograph pickup transducer 310 including a stylus 312 that responds to the modulations in the groove of a record disc recorded in the above-described manner to supply the $L_T$ signal and the $S_1$ single sideband signal with carrier, and the $R_T$ signal together with the $S_2$ single sideband signal with carrier, along a pair of conductors 314 and 316, respectively, to a pair of preamplifiers 318 and 320, respectively. The stereophonic pickup has a good frequency response up to the highest frequency of interest of the modulated carrier recorded on the record; viz., up to about 35 KHz. The output from preamplifer 318 is applied in parallel to a low pass filter 322 designed to transmit audio frequencies up to a frequency $f_1$ which is at or near the upper frequency of the baseband signals being reproduced, and to a high pass filter 324 designed to transmit frequencies above the frequency $f_2$ which, typically, includes a part of the carrier and all of the upper sideband of the modulated signal. The signal from preamplifier 320 is likewise applied in parallel to a low pass filter 326 and a high pass filter 328, each having characteristics corresponding to the characteristics of the described filters 322 and 324, respectively.

The signals transmitted by low pass filters 322 and 326, namely the composite signals $L_T$ and $R_T$, are applied to the input terminals of an "SQ" type decoder matrix 120 which may be of various types as set forth in applicant's copending U.S. application Ser. No. 338,691, filed Mar. 7, 1973, now U.S. Pat. No. 3,835,255, and which is preferably of the type described herein and below in conjunction with FIG. 4. The matrix 120 produces four output signals designated $L_f'$, $L_b'$, $R_b'$, and $R_f'$ which respectively contain, in predominant proportion, the original independent audio signals $L_f$, $L_b$, $R_b$, and $R_f$. Each of the four output signals also contains, in sub-dominant proportion, two "unwanted" components from among the four original signals. The four output signals from matrix 120 are coupled to combining circuitry 130. The output signals from high pass filters 324 and 328 are applied to respective detectors 332 and 334 which are operative to detect the modulation on the carriers and recover the original auxiliary signals $S_1$ and $S_2$, respectively. These auxiliary signals are also coupled to the combining circuitry 130 which utilizes the auxiliary signals to further process the outputs of matrix 120 in order to obtain "enhanced" audio signals or to obtain the four individual audio signals in substantially their original form.

The recording and reproducing systems set forth in FIGS. 1 and 2 are of the type disclosed in the abovereferenced U.S. Pat. No. 3,761,628 and that patent can be referred to for further detail. However, it will be appreciated that this invention applies equally well to any suitable technique of recording and reproducing signals which are encoded and decoded in accordance with the present teachings.

Figure 3:
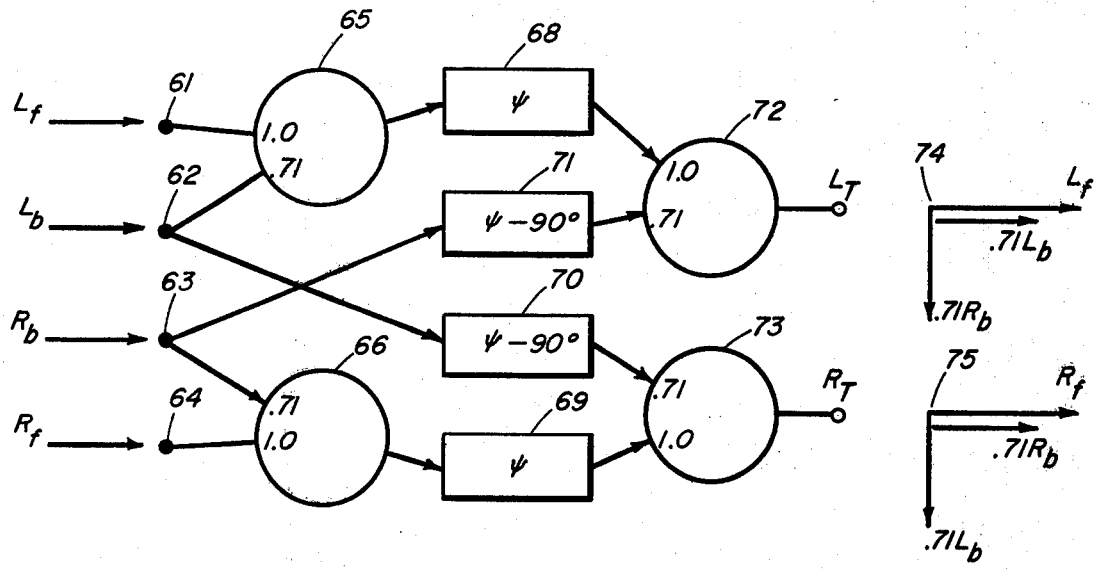
FIG. 3 is a block diagram of an encoding matrix useful in the system of FIG. 1.

The encoder 20 includes a matrix of the type disclosed in applicant's copending application Ser. No. 384,334 now U.S. Pat. No. 3,890,466, and shown in FIG. 3. The matrix has four input terminals 61, 62, 63 and 64 which respectively receive the four independent audio signals $L_f$, $L_b$, $R_b$ and $R_f$ which are available as inputs to the encoder 20 (FIG. 1). Phasor representations of these four signals are depicted next to their respective input terminals. As described in detail in the referenced application, the $L_f$ signal is added to 0.71 of the $L_b$ signal by the summing circuit 65 and the output is applied to an all-pass phase shifter 68 which introduces a reference phase shift $\Psi$ at all frequencies of interest. The $R_f$ signal at input terminal 64 is added to 8.71 of the $R_b$ signal by the summing circuit 66 and the output is applied to an all-pass phase shifter 69 which also introduces a reference phase shift $\Psi$. The $L_b$ and $R_b$ signals are also applied to respective all-pass phase shift networks 70 and 71, each of which provides a phase shift of $\Psi - 90°$. The output of network 68 is added to 0.71 of the output of network 71 by summing circuit 72 to produce the composite signal $L_T$. Similarly, the output of network 69 is added to 0.71 of the output of network 70 by summing circuit 73 to produce the composite signal $R_T$. The encoder of FIG. 3 is known as a "forward-looking" type of "SQ" encoder and produces the composite signals $L_T$ and $R_T$ illustrated by the phasor groups 74 and 75. Characteristically, $L_T$ includes $L_f$ in a dominant proportion and $L_b$ and $R_b$ in subdominant proportions (0.71) and in phase quadrature with respect to each other while $R_T$ includes $R_f$ in a dominant proportion and $R_b$ and $L_b$ in subdominant proportions and in phase quadrature with respect to each other. Also, the $L_b$ component in $L_T$ is in its original phase relationship with the $R_b$ component in $R_T$ and the $R_b$ component in $L_T$ is in its original phase relationship with the $L_b$ component in $R_T$. Using conventional phasor notation, the composite signals can be represented by the equations $$L_T = L_f + 0.71L_b - j0.71R_b$$
$$R_T = R_f + 0.71R_b - j0.71L_b$$

Figure 4:
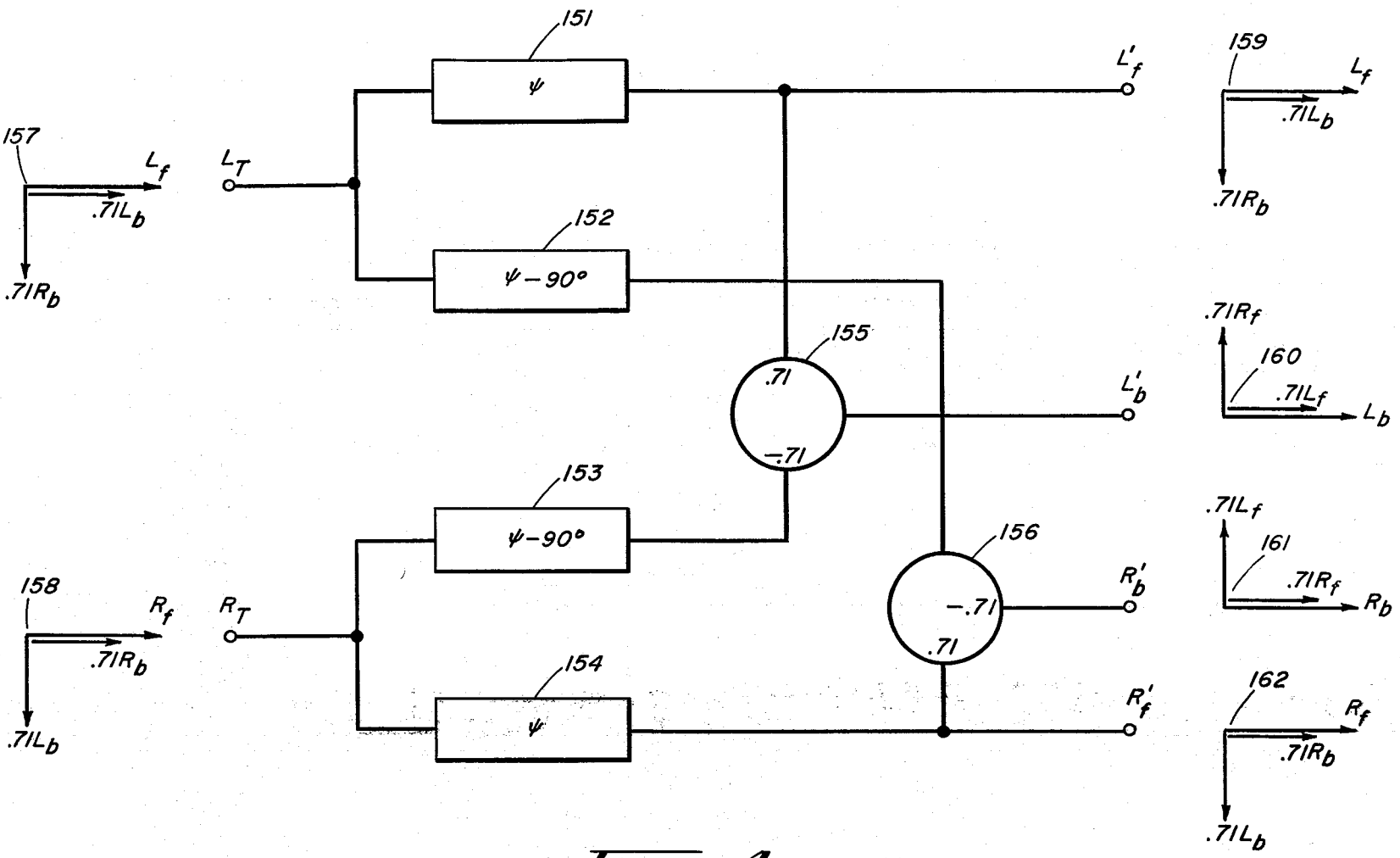
FIG. 4 is a block diagram of a decoder matrix useful as part of the part of the reproducing system of FIG. 2.

A suitable decoder matrix 120 (FIG. 2) is illustrated in FIG. 4 which shows a matrix that is functionally the same as one disclosed in my copending application Ser. No. 338,691, filed and assigned to the same assignee as the present invention. Four all-pass phase shift networks 151, 152, 153 and 154 and a pair of summing circuits 155 and 156 are arranged in the manner shown to decode $L_T$ and $R_T$ and obtain the four output signals $L_f'$, $L_b'$, $R_b'$ and $R_f'$. The phasor groups 157 and 158 represent $L_T$ and $R_T$, respectively, and the phasor groups 159, 160, 161 and 162 represent the decoded outputs $L_f'$, $L_b'$, $R_b'$ and $R_f'$, respectively. In equation form, the decoded outputs can be expressed as follows:

$$L_f' = L_f + 0.71L_b - j0.71R_b$$
$$L_b' = L_b + 0.71\ L_f + j0.71R_f$$
$$R_b' = R_b + 0.71R_f + j0.71L_f$$
$$R_f' = R_f + 0.71R_b - j0.71L_b$$

Figure 5A:
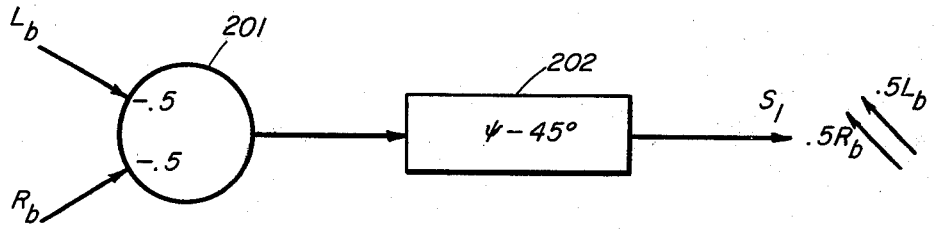
FIG. 5A is a block diagram of a circuit used to generate an auxiliary signal in accordance with the invention.
Figure 5B:
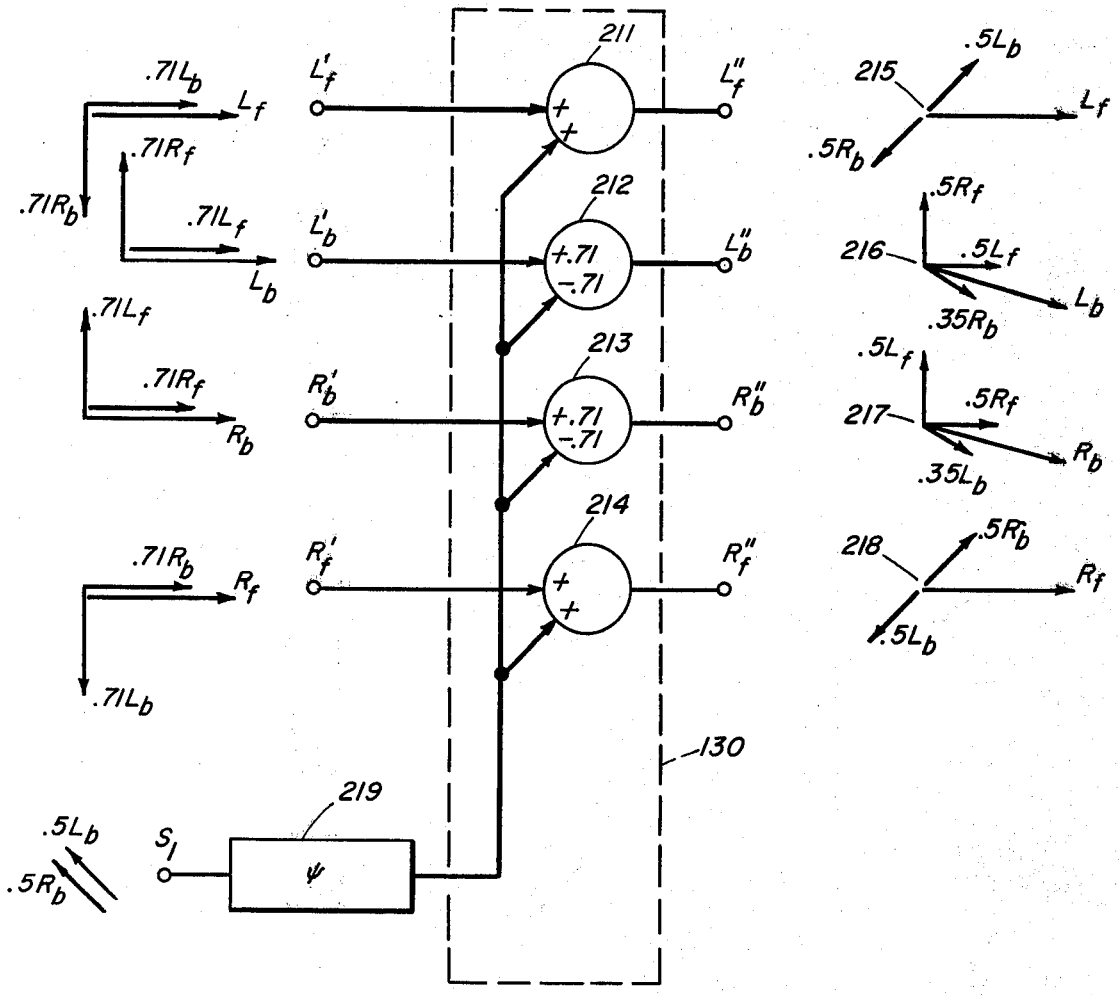
FIG. 5B is a block diagram of the combining circuitry of FIG. 2 in accordance with a particular embodiment of the invention.

FIGS. 5A and 5B illustrate an embodiment of the invention wherein only a single auxiliary signal, $S_1$, need be recorded and this auxiliary signal can be utilized by consumers having relatively simple combining circuitry 130 to obtain significantly enhanced audio output signals. The signal $S_1$ can be recorded and reproduced in the manner described in FIGS. 1 and 2 (i.e., with $S_2 = 0$) but, preferably, $S_1$ will be recorded on and reproduced from both walls of the record groove; that is, with $S_2 = S_1$. FIG. 5A shows the portion of encoder block 20 (FIG. 1) which is used to generate $S_1$ for this embodiment. A summing circuit 201 adds $-.5L_b$ to $-.5R_b$ and this sum is phase shifted ($\Psi - 45°$) by an all pass phase shift network 202. At the reproducing end, the detectors (FIG. 2) recover $S_1$ which is coupled via all-pass phase shift network 219 (FIG. 5B) to combining circuit 130 along with the decoded "SQ" outputs $L_f'$, $L_b'$, $R_b'$ and $R_f'$. As shown in FIG. 5B, the combining circuit 130 for this embodiment includes four summing circuits labelled 211 through 214. The network 219 introduces a reference phase shift $\Psi$ to $S_1$. This establishes the proper phase reference for $S_1$ since all the decoded "SQ" outputs had experienced this same reference phase shift during decoding (see FIG. 4). The four enhanced outputs, designated $L_f''$, $L_b''$, $R_b''$ and $R_f''$ can be seen to have the following formulations:

$$L_f'' = L_f' + S_1$$
$$L_b'' = 0.7L_b' - 0.7S_1$$
$$R_b'' = 0.7R_b' - 0.7S_1$$
$$R_f'' = R_f' + S_1$$

The phasor representations of the enhanced outputs are illustrated by phasor groups 215 through 218. In addition to infinite front separation, the enhanced outputs exhibit 6dB separation from front-to-back and 9dB separation between the back channels. Thus, front-to-back separation is about twice the separation normally achieved with ordinary "SQ"decoded outputs.

Figure 6A:
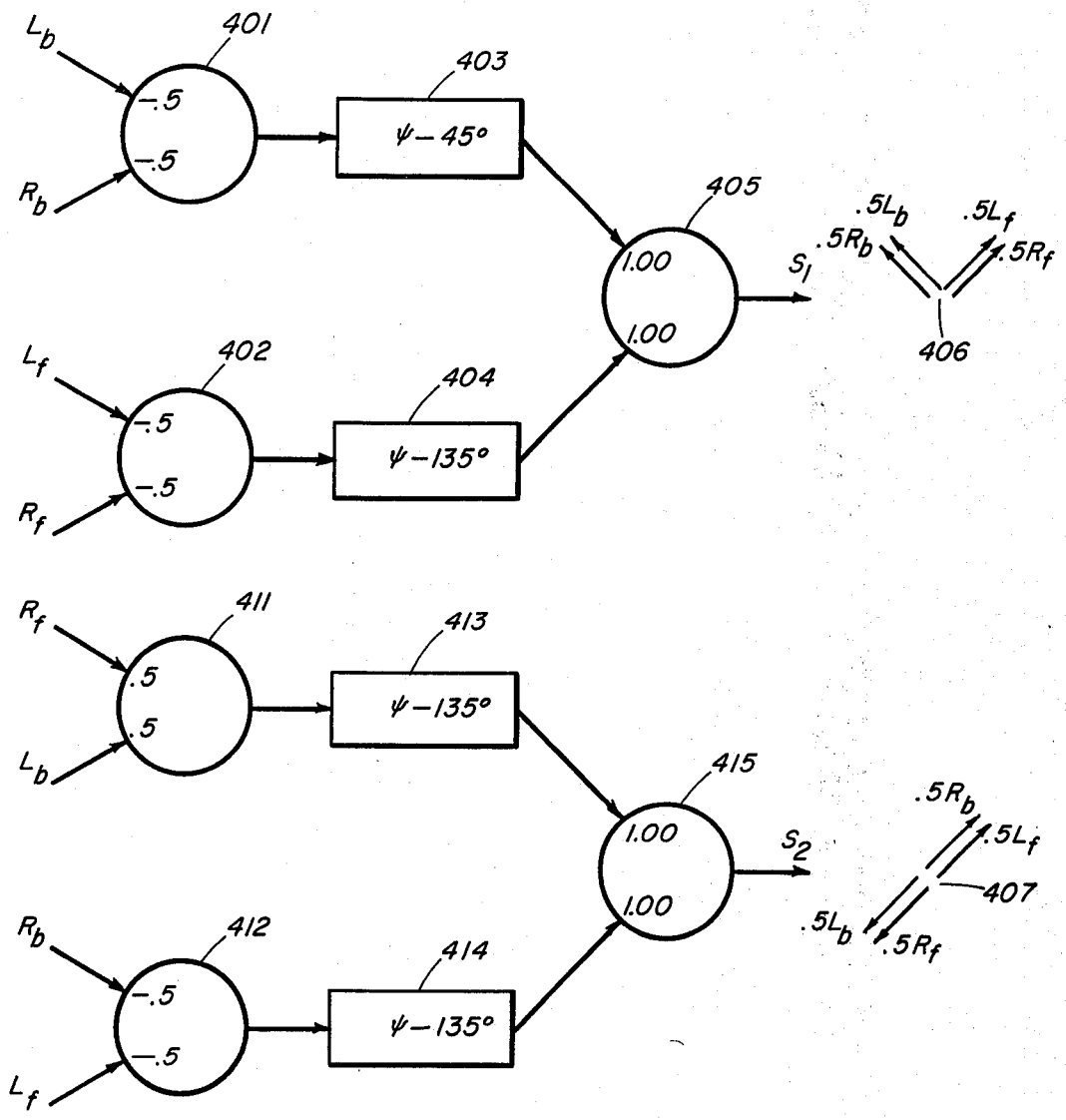
FIG. 6A is a block diagram of circuitry used to generate auxiliary signals in accordance with an embodiment of the invention.
Figure 6B:
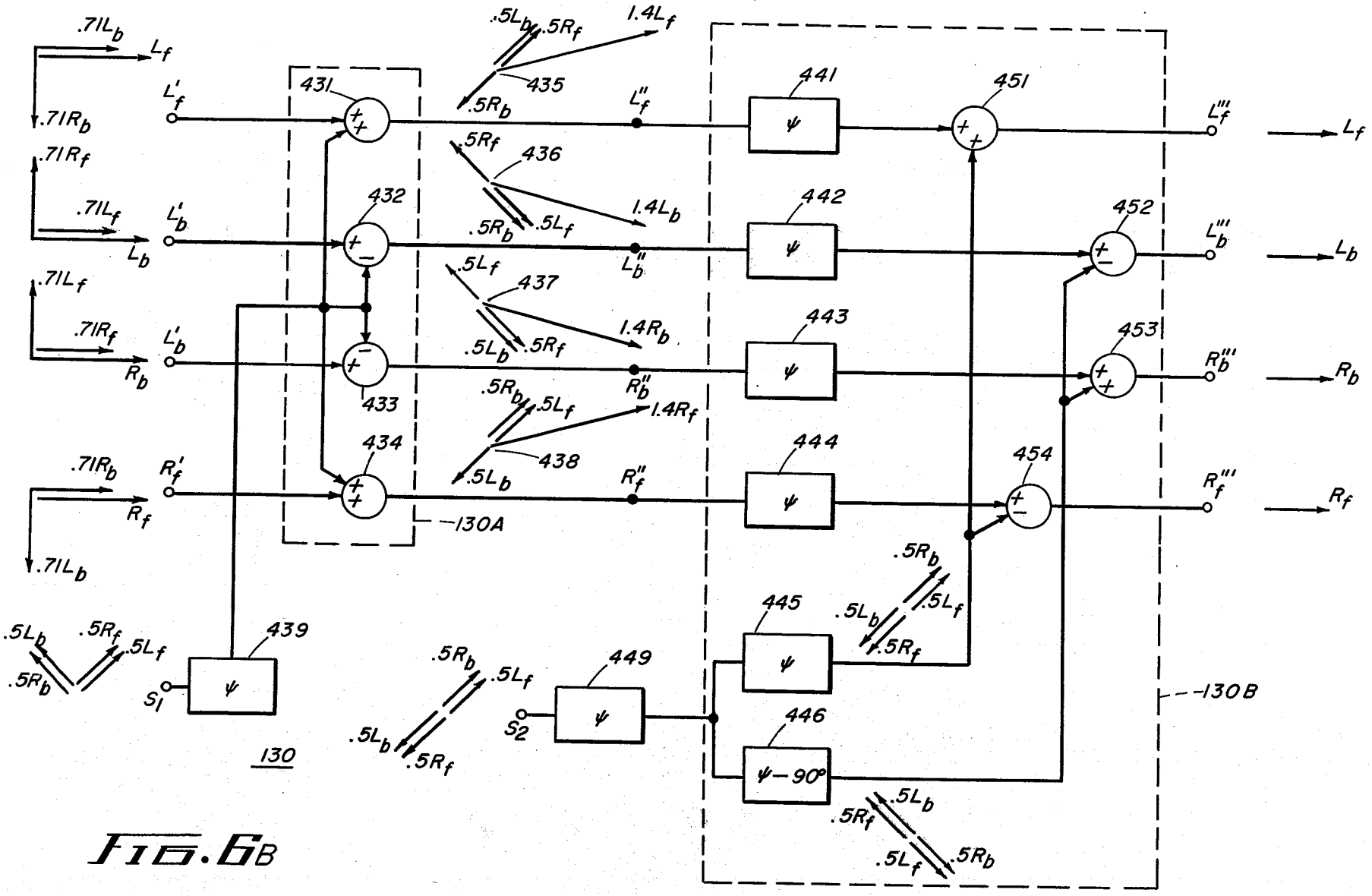
FIG. 6B is a block diagram of the combining circuitry of FIG. 2 in accordance with another embodiment of the invention.

FIGS. 6A and 6B illustrate an embodiment of the invention wherein a preferred pair of auxiliary signals, $S_1$ and $S_2$, are recorded, and these auxiliary signals are utilized by consumers having a certain type of combining circuitry 130 to recover the original four independent audio signals in fully discrete form. In the present embodiment an advantage is that certain consumers having less sophisticated (and less expensive) combining circuitry can utilize only one of the two auxiliary signals to obtain significantly enhanced audio output signals while consumers having a more sophisticated type of combining circuitry can utilize both auxiliary signals to obtain fully discrete audio output signals. Thus, an advantage of greater flexibility is achieved and the consumer is given viable purchase options. FIG. 6A shows the portion of encoder block 20 (FIG. 1) which is used to generate $S_1$ and $S_2$ for this embodiment. $S_1$ is generated using a pair of summing circuits 401 and 402 to respectively form the signals ($-.5L_b - .5R_b$) and ($-.5L_f - .5R_f$). The former signal is passed through an all-pass phase shift network 403 which introduces a relative phase shift of ($\Psi - 45°$) and the latter signal is passed through an all-pass phase shifter 404 which introduces a relative phase shift of ($\Psi - 135°$). The outputs of these phase shifting networks are added by summing circuit 405 to produce the auxiliary signal $S_1$ which is illustrated by the phasor group labelled 406. The auxiliary signal $S_2$ is formed in a similar manner. In this case, summing circuits 411 and 412 are used to form signals $(.5R_f + .5L_b)$ and $(-.5R_b - .5L_f)$. The outputs of the summing circuits are coupled through all-pass phase shift networks 413 and 414 which introduce relative phase shifts of $(\Psi - 135°)$. The resultant signals are added by summing circuit 415 to produce auxiliary signal $S_2$ shown by phasor grouping 407. It can be noted that each of the auxiliary signals $S_1$ and $S_2$ contains a component of each of the four original independent audio signals but that the phase relationships are different in the two auxiliary signals. Again, at the receiving end, detector 110 (FIG. 5) recovers $S_1$ and $S_2$ which are coupled via reference phase shifters 439 and 449 to combining circuit 130 along with the decoded "SQ" outputs $L_f'$, $L_b'$, $R_b'$and $R_f'$. As shown in FIG. 6B, the combining circuit 130 consists of two stages 130A and 130B, each being shown in a dashed enclosure. The stage 130A consists of four summing circuits labelled 431 through 434. As shown, the summing circuits are used to combine $L_f'$, $L_b'$, $R_b'$ and $R_f'$ in accordance with the following relationships:

$$L_f'' = L_f' + S_1$$
$$L_b'' = L_b' - S_1$$
$$R_b'' = R_b' - S_1$$
$$R_f'' = R_f' + S_1$$

The outputs of stage 130A are represented by the phasor groupings labelled 435 through 438. It will be appreciated that the outputs of the stage 130a can be utilized as the final audio outputs by consumers whose combining circuitry consists solely of the stage 130A. These outputs exhibit channel separation of 9dB for all adjacent channels. The stage 130A requires only the four relatively inexpensive summing circuits and the phase shifter 439, so a consumer who choses this compromise can obtain enhanced "SQ" outputs without undue expense.

Consumers having the more sophisticated combining circuitry 130 will have a second stage 130B which receives the four outputs $L_f''$, $L_b''$, $R_b''$, and $R_f''$, and couple each of these outputs through respective all-pass phase shift networks 441 through 444, each of these phase shift networks introducing a reference phase shift of $\Psi$. The auxiliary signal $S_2$ is coupled through reference phase shift network 449 to a pair of phase shift networks 445 and 446, the network 445 introducing a reference phase shift of $\Psi$ and the network 446 introducing a relative phase shift of $(\Psi - 90°)$. Four summing circuits 451 through 454 are also provided in the stage 130B. The summing circuit 441 adds the output of phase shifting network 441 to $S_2$. As a result of this addition, the components $L_b$, $R_b$ and $R_f$ all cancel out and the resultant output, $L_f'''$, equals $L_f$, the original independent audio signal. Similarly, the output of network 445 is subtracted from the output of network 444 by summing circuit 454 to obtain $R_f'''$ which equals $R_f$, the original independent audio signal. The output of all-pass phase shift network 446 is added to the output of phase shift network 443 by summing circuit 453 to obtain $R_b'''$ which equals $R_b$, the original independent audio signal. Finally, the output of network 446 is subtracted from the output of network 442 to obtain $L_b'''$ which equals $L_b$, the original independent audio signal. Thus, by employing seven additional all-pass phase shift networks and four additional summing networks, a consumer having the full equipment can further discretize the outputs of the first stage 130A to obtain four fully discrete audio signals.

I claim:

1. A compatible four channel sound system for use in conjunction with a recording system for recording four individual audio signals designated $L_f$, $L_b$, $R_b$ and $R_f$ on a recording medium having first and second primary information channels and a subsidiary information channel, said first and second primary information channels carrying information that is consistent and compatible with existing monophonic and stereophonic standards, comprising:

a. means for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other;

b. means for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other;

c. means for forming an auxiliary signal which consists of only the individual audio signals $L_b$ and $R_b$, in equal proportion, to the extent they are present, both components of said auxiliary signal being in a 45° phase relationship with the $L_b$ and $R_b$ components in said composite signals, $L_T$ and $R_T$;

d. means for applying said first and second composite signals to said first and second primary information channels, respectively; and e. means for applying said auxiliary signal to said subsidiary channel.

2. A system as defined by claim 1 wherein the composite signals $L_T$ and $R_T$ are formed such that $L_b$ in one composite signal is in its original phase relationship with $R_b$ in the other composite signal and $R_b$ in said one composite signal is in its original phase relationship with $L_b$ in said other composite signal.

3. In a compatible four channel audio system for use in conjunction with a recording system for recording four individual audio signals designated $L_f$, $L_b$, $R_b$ and $R_f$, on a recording medium having first and second primary information channels and a subsidiary information channel, said first and second primary information channels carrying information that is consistent and compatible with existing monophonic and stereophonic standards, wherein said first primary information channel carries a first composite signal designated $L_T$ which contains, to the extent they are present, $L_f$ in a dominant proportion and $L_b$ and $R_b$ in subdominant proportions, $L_b$ and $R_b$ being phase shifted with respect to each other, said second primary information channel carries a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other, and said subsidiary channel carries an auxiliary signal which consists only of the individual audio signals $L_b$ and $R_b$, to the extent they are present; a decoder responsive to the signals carried by said medium, comprising:

a. matrix means for combining said first and second composite signals in predetermined amplitude and phase relationships to obtain four intermediate signals each of which has a different one of said individual audio signals predominant; and b. means for combining said auxiliary signal with each of said intermediate signals to obtain four output signals, each having a different one of said individual audio signals predominant, said combining means comprising means for phase shifting said auxiliary signal and means for adding said phase shifted auxiliary signal to two of said intermediate signals and means for subtracting said phase shifted auxiliary signal from the other two of said intermediate signals.

4. A compatible four channel sound system for use in conjunction with a recording system for recording four individual audio signals designated $L_f$, $L_b$, $R_b$ and $R_f$ on a recording medium having first and second primary information channels and first and second subsidiary information channels, said first and second primary information channels carrying information that is consistent and compatible with existing monophonic and stereophonic standards, comprising:

a. means for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other;

b. means for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other;

c. means for forming a first auxiliary signal by combining all of the individual audio signals, $L_f$, $L_b$, $R_b$, and $R_f$, to the extent they are present, $L_b$ and $R_b$ being added in their original phase relationship and $L_f$ and $R_f$ being added in their original phase relationship and in phase quadrature with the sum of $L_b$ and $R_b$;

d. means for forming a second auxiliary signal by combining all of the individual audio signals, $L_f$, $L_b$, $R_b$, and $R_f$, to the extent they are present, said individual audio signals being combined in different relative phase relationships in said first and second auxiliary signals;

e. means for applying said first and second composite signals to said first and second primary information channels, respectively; and f. means for applying said first and second auxiliary signals to said first and second subsidiary channels respectively.

5. A system as defined by claim 4 wherein the composite signals $L_T$ and $R_T$ are formed such that $L_b$ in one composite signal is in its original phase relationship with $R_b$ in the other composite signal and $R_b$ in said one composite signal is in its original phase relationship with $L_b$ in said other composite signal.

6. In a compatible four channel audio system for use in conjunction with a recording system for recording four individual audio signals designated $L_f$, $L_b$, $R_b$, and $R_f$, on a recording medium having first and second primary information channels and first and second subsidiary information channels, said first and second primary information channels carrying information that is consistent and compatible with existing monophonic and stereophonic standards, wherein said first primary information channel carries a first composite signal designated $L_T$ which contains, to the extent they are present, $L_f$ in a dominant proportion and $L_b$ and $R_b$ in sub-dominant proportions, $L_b$ and $R_b$ being phase shifted with respect to one another, said second primary information channel carries a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other, said first and second subsidiary channels carrying first and second auxiliary signals, each of said auxiliary signals including all of the individual audio signals $L_f$, $L_b$, $R_b$ and $R_f$, to the extent they are present, with the individual audio signals being combined in different relative phase relationships in said first and second auxiliary signals; a decoder responsive to the signals carried by said medium, comprising:

a. matrix means for combining said first and second composite signals in predetermined amplitude and phase relationships to obtain four intermediate signals each of which has a different one of said individual audio signals predominant;

b. means for combining said first auxiliary signal with each of said intermediate signals to obtain four enhanced intermediate signals, each having a different one of said individual audio signals predominant, said combining means comprising means for phase shifting said auxiliary signal and means for adding said phase shifted auxiliary signal to two of said intermediate signals and means for subtracting said phase shifted auxiliary signal from the other two of said intermediate signals, and c. means for combining said second auxiliary signal with each of said enhanced intermediate signals to recover said four individual audio signals in substantially their original form.

* * * * *